United States Patent [19]

Fleckenstein et al.

[11] Patent Number: 4,695,685

[45] Date of Patent: Sep. 22, 1987

[54] ROTATING PADDLE BIN LEVEL INDICATOR

[75] Inventors: Phillip P. Fleckenstein; Norman F. Marsh, both of Port Huron, Mich.

[73] Assignee: Berwind Corporation, Philadelphia, Pa.

[21] Appl. No.: 889,699

[22] Filed: Jul. 28, 1986

[51] Int. Cl.[4] ..... H01H 35/00

[52] U.S. Cl. ..... 200/61.21; 340/617

[58] Field of Search ..... 200/61.2, 61.21; 340/612, 613, 614, 615, 616, 617

[56] References Cited

U.S. PATENT DOCUMENTS 4,211,966 7/1980 Sweet ..... 200/61.21 X

*Primary Examiner*—A. D. Pellinen

*Assistant Examiner*—Morris Ginsburg

*Attorney, Agent, or Firm*—Barnes, Kisselle, Raisch, Choate, Whittemore & Hulbert

[57] ABSTRACT

Apparatus for indicating the level of flowable material in a storage bin comprising a motor mounted within a protective enclosure and coupled by a shaft to a paddle disposed within the bin to engage material contained therein. When the material reaches the level of the paddle, drag on the paddle causes the motor to rotate within the enclosure and thereby to activate switches disposed within the enclosure for indicating material level. A spring is mounted between the enclosure and the motor such that the spring urges the motor to both the switch-activating and the switch-deactivating positions in turn, and must be urged over center to permit motion of the motor in either direction between such positions.

5 Claims, 3 Drawing Figures

ROTATING PADDLE BIN LEVEL INDICATOR

The present invention relates to bin level indicators, and more particularly to an improved apparatus of the rotating paddle type for indicating the level of flowable material in a storage tank or bin.

Bin level indicators of the above-noted type typically comprise a motor carried for limited rotation within a protective enclosure and connected to a rotatable paddle which is adapted to engage flowable material within a storage bin when the material rises to the bin level at which the rotating paddle is disposed. Material drag on the paddle causes the motor drive torque to rotate the motor rather than the paddle, which rotation is normally sensed by one or more switches carried within the enclosure. The switches may be connected to deactivate a conveyor feeding material to the bin, to remove power from the indicator motor and/or to perform other control functions related to material level. Examples of bin level indicators of the described type are shown in the U.S. patents of Grostick U.S. Pat. No. 2,851,553, Gruber U.S. Pat. No. 3,542,982, Levine U.S. Pat. No. 4,147,906 and Roach U.S. Pat. No. 4,392,032. A problem is encountered in application of conventional apparatus to lightweight materials such as fly ash, and plastic powder and pellets. Specifically, light material weight does not always maintain sufficient drag on the paddle to maintain the motor in engagement with the switches, causing intermittent activation and deactivation of the switches even when material level remains substantially constant.

It is a general object of the present invention to provide an improved rotating paddle bin level indicator which is more economical to fabricate and assemble than are prior art indicators of similar type. In furtherance of the object stated immediately above, it is another object of the invention to provide an improved rotating paddle bin level indicator which has a reduced number of component parts, and in which component parts may be either purchased as standard off-the-shelf elements or may be fabricated at minimum expense. A further and yet more specific object of the invention is to provide rotating paddle bin level indicating apparatus of the subject type which embodies hysteresis in the switch-activating mechanism, such that the motor must overcome a definite limited force in motion from the switch-activating position to the deactivating position, as well as in the opposite direction.

The invention, together with additional objects, features and advantages thereof, will be best understood from the following description, the appended claims and the accompanying drawing in which:

Figure 1:
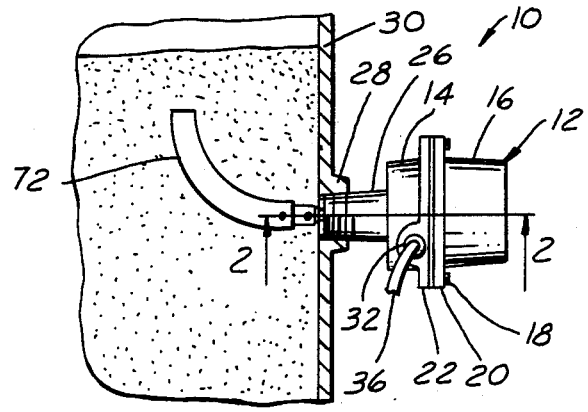
FIG. 1 is a fragmentary elevational view, partly in section, showing a presently preferred embodiment of a bin level indicator provided by the invention.
Figure 2:
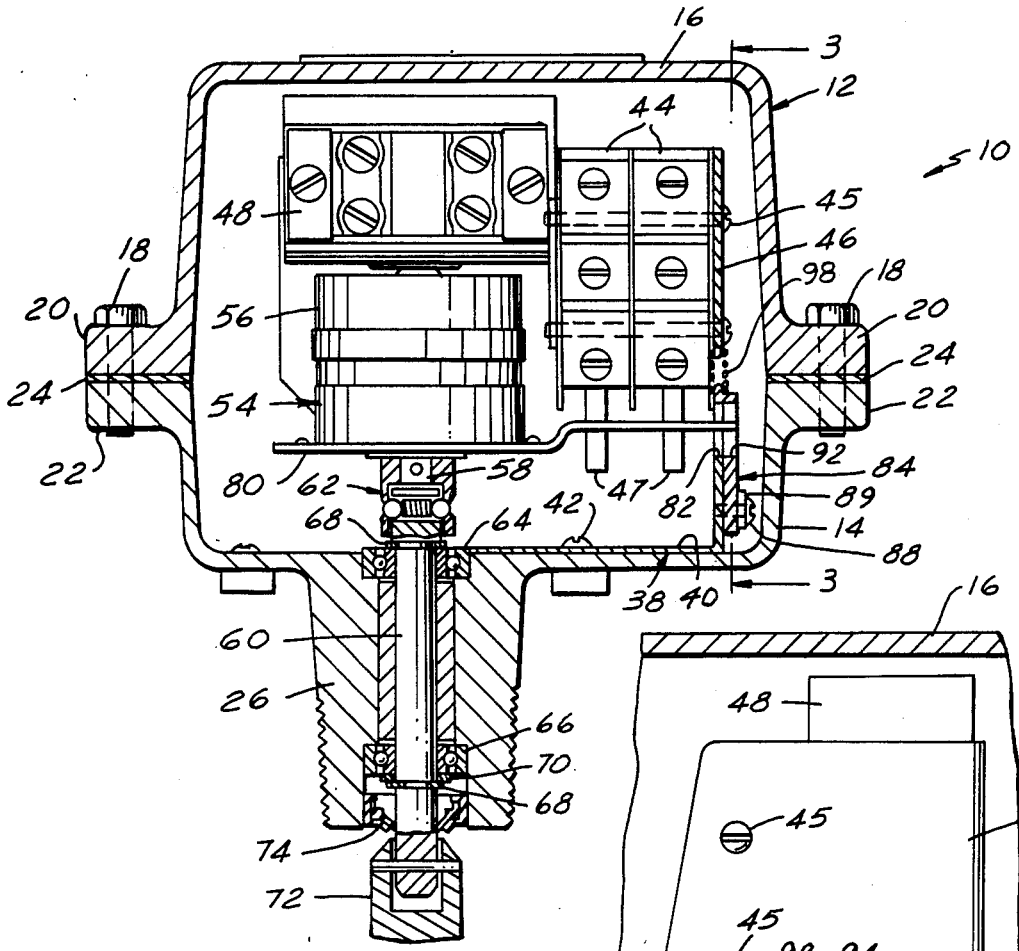
FIG. 2 is a fragmentary side sectional view of the indicator shown in FIG. 1 taken substantially along the line 2—2 in FIG. 1.
Figure 3:
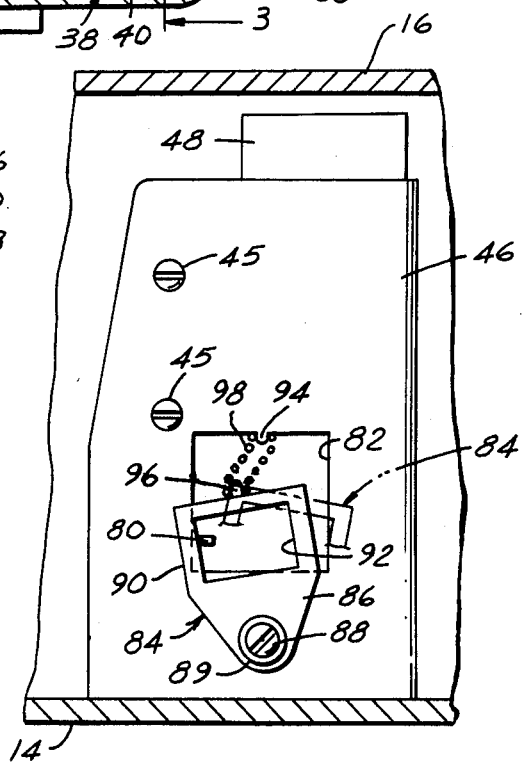
FIG. 3 is a fragmentary sectional view taken substantially along the line 3—3 in FIG. 2.

Referring to FIGS. 1–3, a presently preferred embodiment 10 of the bin level indicator provided by the present invention includes a generally rectangular protective housing or enclosure 12 comprising a shallow cup-shaped enclosure base 14 and a deeper cup-shaped enclosure top or cover 16. Cover 16 is mounted to base 14 by bolts 18 extending through apertures in a radially extending flange 20 on cover 16 into threaded apertures in a corresponding base flange 22. A sealing gasket 24 is disposed between the respective flanges. A hollow externally threaded nipple 26 extends outwardly from base 14 and is adapted to be threadably received in a corresponding internally threaded gland 28 (FIG. 1) carried by the wall of a material storage tank or bin 30. An internally threaded laterally opening aperture 32 (FIG. 1) is formed adjacent to base flange 22 to receive a strain-relief grommet or the like through which is fed a multiple-conductor electrical cable 36 adapted for connection to level indicating apparatus (not shown) disposed externally of enclosure 12.

Internally, indicator 10 includes an open three-sided bracket 38 having a lower wall 40 mounted by screws 42 to base 14. A pair of switches 44 are mounted by screws 45 to the side wall 46 of bracket 48 and have depending actuator arms 47 for activating and deactivating internal electrical contacts. Conductors (not shown) connect switches 44 to a terminal block 48 mounted on bracket 38, from which connection is fed to external circuitry (not shown) by cable 36 (FIG. 1). A motor 54 is carried within enclosure 12 and comprises a generally cylindrical motor housing 56 having a rotatable shaft 58 extending axially from one end thereof. A paddle drive shaft 60 is coupled to motor output shaft 58 by the ball-and-detent clutch assembly 62. Paddle drive shaft 60 extends through the roller bearings 64, 66 which are press fitted into corresponding recesses in enclosure mounting nipple 26, and is axially positioned therein by the retaining rings 68 received in corresponding grooves in the drive shaft on respectively opposite sides of bearings 64, 66. An annular leaf spring or belleville spring washer 70 is captured between retaining ring 68 and bearing 66 to absorb axial shock on the drive shaft caused by rocks or the like striking paddle 72. Thus, drive shaft 60 is held at fixed axial position with respect to apparatus enclosure 12, and motor 54 effectively floats within the enclosure cantilevered from the drive shaft. A lip seal assembly 74 is press fitted into the housing-remote end of gland 26 and circumferentially engages shaft 60 as the latter exits gland 26. Paddle 72 terminates in a collar which is pinned to the free end of shaft 60 received telescopically therein. To the extent thus far described, bin level indicating apparatus 10 is of generally similar construction to those illustrated in the above-noted Levine and Roach patents.

An arm 80 is mounted to the base of motor housing 56 and projects therefrom radially of motor shaft 58 adjacent to switch actuators 47 through a rectangular opening 82 in bracket wall 46. As such, the arm 80 and motor moves in unison. A flat rocker 84 has a generally triangular base 86 pivotally mounted by a screw 88 and a bearing washer 89 to bracket wall 46 externally of motor 54 and beneath opening 82. The upper portion 90 of rocker 84 is of generally rectangular outline and contains a rectangular aperture 92 having a long dimension perpendicular to the axis of pivot screw 88. Motor arm 80 projects through bracket aperture 82 into rocker aperture 92 for internally engaging the laterally opposed side edges of rocker aperture 92. A nub 94 centrally depends from the upper edge of bracket aperture 82. A corresponding nub 96 projects upwardly from the upper edge of rocker 84, nub 96 being aligned with and perpendicular to the axis of pivot screw 88. Nubs 94, 96 extend into opposed ends of a coil spring 98 and capture coil spring 98 in compression between the upper edge of bracket aperture 82 and the upper edge of rocker 84.

In operation, motor 54 and motor arm 80 are normally disposed in a first position illustrated in solid lines in FIGS. 2 and 3, with arm 80 spaced from switch actuator arms 47, and with rocker 84 pivoted to the extreme left-most position as shown in FIG. 3. When material engages paddle 72 and retards paddle rotation, motor 54 rotates such that motor arm 80 moves into, engages and depresses switch actuator arms 47 to indicate material level. At the same time, and prior to actuating switches 44, arm 80 moves to the right in FIG. 3 to engage the opposing side of rocker 84, so that spring 98 is biased against and retards further motor rotation. However, if rotation of paddle 72 remains stalled, the force of arm 80 against rocker 84 is sufficient to overcome the force of spring 98, so that rocker 84 pivots to a second position shown in phantom in FIG. 3. In doing so, however, spring 98 is initially moved to a central position in which nubs 94, 96 are aligned and the spring axis perpendicularly intersects the axis of pivot screw 88, following which the spring moves over center so as to urge rocker 84 to the position shown in phantom. Thus, in the event that drag is removed from paddle 72, motor 54 and arm 80 must again overcome the force of spring 98 to move rocker 84 from the activated (phantom) or second position to the deactivated (solid) or first position of FIG. 3.

It will also be noted that the lateral dimension of rocker aperture 92 is substantially greater than lateral width of arm 80, such that a substantial portion of initial motion of motor 54 and arm 80 in either direction constitutes lost motion with reference to rocker 84. Thus, disposition of spring 98 such that compressive spring forces must be overcome in motion of motor 54 and arm 80 in either direction, coupled with lost motion connection between arm 80 and rocker 84, effectively adds hysteresis to the switch-activating mechanism so as to overcome problems associated with lightweight materials as previously discussed.

The invention claimed is:

1. Apparatus for indicating level of material in a storage bin comprising a hollow enclosure including means for mounting said enclosure to a storage bin, a motor mounted for limited movement within said enclosure between first and second positions, a paddle operatively coupled to said motor and constructed to be disposed for rotation within said bin, rotation of said paddle being retarded when material stored in said bin is at a level so as to stallably engage said paddle, means mounted in fixed position within said enclosure for detecting limited movement of said motor between said first position when rotation of said paddle is not retarded by material stored in the bin and said second position when rotation of said paddle is retarded by material stored in said bin, and spring means extending between means projecting from said motor and means affixed to said enclosure for urging said motor to both said first and second positions such that said spring means must be urged over center during motion of said motor in either direction between said first and second positions.

2. The apparatus set forth in claim 1 wherein said means affixed to said enclosure comprises a bracket, and where said spring means comprises a coil spring, a rocker mounted to pivot on said bracket between first and second positions corresponding to said first and second positions of said motor, and means for mounting said coil spring to said rocker and bracket such that said spring must be urged over center during motion of said motor in either direction between said first and second positions.

3. The apparatus set forth in claim 2 wherein said coil spring is mounted to said rocker and said bracket such that the axis of said spring intersects the pivot axis of said rocker midway between said first and second positions of said rocker, and wherein said means projecting from said motor engages said rocker so as to pivot said rocker during motion of said motor.

4. The apparatus set forth in claim 3 wherein said means projecting from said motor comprises lost motion means, such that initial motion of said motor from either said first or second position causes no corresponding pivotal motion of said rocker.

5. The apparatus set forth in claim 4 wherein said lost motion means comprises an aperture in said rocker an an arm projecting from said motor into said aperture.

* * * * *